US007435064B2

(12) United States Patent
Hüttlin

(10) Patent No.: US 7,435,064 B2
(45) Date of Patent: Oct. 14, 2008

(54) OSCILLATING PISTON MACHINE

(76) Inventor: Herbert Hüttlin, Rümminger Strasse 15, 79539 Lörrach (DE)

( * ) Notice: Subject to any disclaimer, the term of this patent is extended or adjusted under 35 U.S.C. 154(b) by 642 days.

(21) Appl. No.: 10/825,997

(22) Filed: Apr. 15, 2004

(65) Prior Publication Data

US 2005/0135950 A1 Jun. 23, 2005

(30) Foreign Application Priority Data

Dec. 23, 2003 (DE) ..... 103 61 566

(51) Int. Cl.
*F03C 2/24* (2006.01)

(52) U.S. Cl. ..... 418/35; 418/68

(58) Field of Classification Search ..... 418/35, 418/68

See application file for complete search history.

(56) References Cited

U.S. PATENT DOCUMENTS 3,075,506 A 1/1963 Berry

FOREIGN PATENT DOCUMENTS

WO WO03/067033 8/2003

*Primary Examiner*—F. Daniel Lopez
(74) *Attorney, Agent, or Firm*—St. Onge Steward Johnson & Reens LLC

(57) ABSTRACT

The invention relates to an oscillating piston machine, comprising a housing which has an essentially spherical housing inner wall, four pistons which rotate together about an axis of rotation which is approximately in the center of the housing being arranged in the housing in which case, of the four pistons in each case two pistons which are approximately diametrically opposite one another with respect to the center of the housing form a rigid piston pair the two piston pairs being capable of pivoting to and fro in opposite directions about a common pivot axis (42) which runs approximately perpendicularly with respect to the axis (40) of rotation, the two piston pairs being arranged in criss-cross fashion with respect to the pivot axis (42) in such a way that in each case two pistons of the two piston pairs have their piston working faces opposite one another in order to form a working chamber between them, each piston pair having a bearing section for mounting the piston pair on the pivot axis and in each case a side wall section for both pistons of the piston pair, for laterally delimiting one of the working chambers in each case. The bearing section and the side wall sections are constructed integrally with one another and are arranged on the same side of the respective piston pair.

28 Claims, 9 Drawing Sheets

OSCILLATING PISTON MACHINE

FIELD OF THE INVENTION

The invention relates to an oscillating piston machine, comprising a housing which has an essentially spherical housing inner wall, four pistons which rotate together about an axis of rotation which is approximately in the center of the housing being arranged in the housing, in which case, of the four pistons, in each case two pistons which are approximately diametrically opposite one another with respect to the axis of rotation form a rigid piston pair, the two piston pairs being capable of pivoting to and fro in opposite directions about a common pivot axis which runs approximately perpendicularly with respect to the axis of rotation, the two piston pairs being arranged in criss-cross fashion with respect to the pivot axis in such a way that in each case two pistons of the two piston pairs have their piston working faces opposite one another in order to form a working chamber between them, each piston pair having a bearing section for mounting the piston pair on the pivot axis, and in each case a side wall section for both pistons of the piston pair, for laterally delimiting one of the working chambers in each case.

Such an oscillating piston machine is known from the document WO03/067033 A1.

Oscillating piston machines belong to a generic type of internal combustion engines in which the individual working strokes of the admission, compression, ignition, expansion and expulsion of the combustion mixture are brought about by oscillating pivoting movements of the individual pistons between two positions.

In the process, the oscillating pistons rotate in the housing, about a common axis of rotation which is fixed to the housing, it being possible to tap the rotating movement of the pistons as a rotary movement of an output shaft. As the oscillating pistons rotate in the housing, the oscillating pistons carry out the aforementioned oscillating pivoting movements.

The previously mentioned known oscillating piston machine has a housing which is of spherical construction on the inside, the pivot axis of the pistons being formed by a common pivot axis which runs approximately through the center of the housing, perpendicularly with respect to the axis of rotation.

In each case two pistons which are diametrically opposite one another with respect to the pivot axis are connected rigidly to one another to form a double piston, there being a bearing section between the two pistons of a piston pair, which bearing section is formed by a narrow bearing ring in the known oscillating piston machine. Both piston pairs are mounted so as to be pivotable with respect to the pivot axis in a criss-cross arrangement, on a journal-forming the pivot axis—by means of their respective bearing ring. The bearing rings of the piston pairs of the known oscillating piston machine are spaced apart from one another approximately at ends of the journal, a further ring, to which the output shaft is attached, being seated on the journal between the two bearing rings.

Furthermore, a side wall section for both pistons of the pair is arranged on each piston pair, opposite the respective bearing section, in order to delimit the two working chambers laterally, the side wall section having a straight face which faces the working chamber and is positioned completely perpendicularly with respect to the pivot axis.

The disadvantage with the known design of an oscillating piston machine of the type mentioned at the beginning is that only a small overall length is available for the respective bearing section in the direction of the pivot axis, as a result of which a higher degree of susceptibility to wear is to be feared for structural reasons. Furthermore, the known oscillating piston machine is also more complex to mount because the bearing ring of the output shaft also has to be positioned on the journal. A further disadvantage is that the output shaft is guided past the pistons, as far as the pivot axis.

The invention is based on the object of improving the oscillating piston machine of the type mentioned at the beginning to the effect that the structural design is simplified, mounting is made easier and the stability of the bearing of the piston pairs on the pivot axis is increased.

According to the invention, this object is achieved with respect to the oscillating piston machine mentioned at the beginning by virtue of the fact that the bearing section and the side wall sections are constructed integrally with one another and are arranged on the same side of the respective piston pair.

In contrast to the known oscillating piston machine, in the oscillating piston machine according to the invention there is accordingly provision for the bearing section and the side wall sections to be integrated one into the other on each piston pair instead of providing the bearing section at one end of the pistons and the side wall sections at the other end, spaced apart from the latter. The configuration according to the invention has the advantage, in particular if the output shaft does not extend as far as the pivot axis that is provided in preferred embodiments, that the bearing section can be made significantly longer in the direction of the pivot axis, and thus made more stable, and furthermore there is the further advantage that the side wall can be constructed with an incline with respect to the pivot axis—as is also provided in a preferred embodiment—instead of being constructed so as to be planar and perpendicular with respect to the pivot axis.

In one preferred embodiment, the bearing section extends in the direction of the pivot axis, over approximately half the width of the piston pair in the direction of the pivot axis.

If the two piston pairs are arranged one next to the other in a criss-cross fashion, the two bearing sections of the piston pairs thus extend in the direction of the pivot axis, over the entire length of the extent of the pistons, as a result of which the individual piston pairs can be mounted on the pivot axis in an extremely stable fashion.

In a further preferred embodiment, the respective side wall section extends on the bearing section so as to curve concavely from the outside to the inside and from the top to the bottom.

This embodiment, which is made possible only by embodying each piston pair according to the invention, has the advantage that the two working chambers or combustion recesses have curved side walls, which proves particularly favorable in terms of the pressure distribution during the ignition and expansion of the fuel/air mixture which is ignited in the working chamber, because the entire expansion force acts on the piston working face and is not used up in explosions at the side walls which cannot make any contribution to the application of force to the pivoting movement.

It is also preferred in this context if the respective side wall section extends in the direction of the pivot axis over the entire length of the bearing section.

By joining together the two piston pairs in a criss-cross fashion, working chambers or combustion recesses which are thus curved in their entirety laterally and at the base, as a result of which during expansion of the ignited fuel/air mixture the entire pressure acts completely on the piston working faces which are of preferably planar design, as a result of which the efficiency of the oscillating piston machine according to the invention is improved in comparison with the known oscillating piston machine.

In order to be able to implement these working chambers, which have an overall recess shape, or combustion recesses, each piston has, at its end opposite the side wall section, a side face whose shape is matched to the side wall section of that piston together with which this piston forms the respective working chamber.

The side wall section of each piston pair thus advantageously forms a guide face for the respective corresponding piston during the oscillating pivoting movement of the pistons.

In expedient and advantageous structural embodiments, each individual piston extends approximately 90° about the axis of rotation. Furthermore, a ratio between a dimension of each piston in the direction of the pivot axis and a dimension of each piston transversely with respect to the pivot axis is preferably in the range from approximately 1.5:1 to 2.5:1, and is preferably 2.2:1. A maximum angle of aperture of the working chambers about the pivot axis is preferably in the range from approximately 40° to approximately 60°, ie. the oscillating pivoting stroke of each individual piston pair is approximately half the previously mentioned maximum angle of aperture.

In a further preferred embodiment, the two piston pairs are seated with their bearing sections on a journal which forms the pivot axis, in each case an end element which is in the form of a spherical cap and which holds the piston pair against one another in the direction of the pivot axis being arranged at the ends of the journal.

This measure has the advantage that, in order to mount the two piston pairs, they merely have to be fitted with their bearing sections on the journal in a criss-cross fashion, this arrangement being held together by fitting the end elements which are in the form of spherical caps onto the ends of the journal and correspondingly firmly connecting the end elements to the journal, ensuring the oscillating pivoting movement of the pistons.

In the process, the end element which is in the form of a spherical cap extends approximately 90° about the axis of rotation.

In conjunction with the embodiment according to which each individual piston extends approximately 90° about the axis of rotation, a spherical construction of this arrangement, which is enclosed at 360° about the axis of rotation is thus obtained for the arrangement from the two piston pairs and the two end elements which are in the form of spherical caps. The end element which is in the form of a spherical cap preferably also extends 90° about an axis which is perpendicular with respect to the axis of rotation and to the pivot axis.

In a further preferred embodiment, the pistons are connected to at least one output shaft which can rotate about the axis of rotation and which ends at the piston end in a first fork section outside the pivot axis, which section is arranged with its two end sections between the end elements and is directly connected to them in a releasable fashion.

Instead of making the output shaft lead to the pivot axis and mounting it there with a bearing ring as in the known oscillating piston machine, this embodiment has the advantage that only the bearing sections of the two piston pairs now have to be mounted on the journal of the pivot axis, as a result of which said bearing sections can be respectively constructed with maximum length in the direction of the pivot axis. The fork section is preferably in the form of a part of a spherical surface on the outside, as a result of which the fork section is inserted into the overall spherically shaped embodiment of the arrangement from the four pistons and the two end elements, and is matched to the housing which is of spherical construction on the inside.

The further advantage of this embodiment is that the at least one output shaft can also be connected to the piston arrangement in a particularly stable fashion because the fork section can extend further in the direction of the pivot axis of the pistons than was the case with the bearing ring of the known oscillating piston machine, with which ring the output shaft was mounted on the journal of the pivot axis. Furthermore, the output shaft no longer has to be guided past the piston, which thus does not restrict the pivoting stroke of the pistons.

It is particularly preferred here if the end sections of the first fork section have a positively locking connection to the end elements.

As a result, a rotationally fixed connection of the first fork section to the end elements, and thus to the piston arrangement, is ensured, which connection is capable of transmitting large torques to the output shaft.

In a further preferred embodiment, the end sections of the first fork section widen starting from the output shaft to their outer end.

It is advantageous that the connection between the first fork section and the two end elements with which the piston pairs are held together can be constructed in a particularly stable fashion.

In expedient and advantageous structural embodiments, a ratio between the dimension of the fork section in the direction perpendicular to the pivot axis in its center with respect to the corresponding dimension of the fork section at its ends is in the range from approximately 1:1.5 to 1:2.5, preferably this ratio is approximately 1:2.

Furthermore, a ratio between the dimension of the fork section in the direction perpendicular to the pivot axis at its ends and the dimension of the fork section in the direction of the pivot axis is preferably in the range from approximately 1:2 to approximately 1:4, and preferably approximately 1:1.375.

A ratio of the thickness of the fork section in the region of the output shaft with respect to the dimension of the fork section in the direction of the pivot axis is preferably in the range from approximately 1:2 to 1:4, and is preferably approximately 1:2.75.

By means of the latter measure, the fork section is made very solid and stable so that it can transmit high torques from the rotating movement of the pistons to the output shaft.

In a further preferred embodiment, a second fork section which is essentially identical in shape and which is connected to the end elements in a releasable fashion is arranged opposite the first fork section.

Overall, a spherical construction of the overall arrangement composed of the piston pairs, the end elements which are in the form of spherical caps and the two fork sections is thus obtained, it being possible to construct all the elements of this arrangement in a particularly stable and solid fashion.

The second fork section preferably has a further output shaft so that the oscillating piston machine according to the invention has a total of two output shafts, the one being able to serve, for example, for driving assemblies such as a dynamo and the like, and the other output shaft being able to extend to a clutch or a transmission if the oscillating piston machine according to the invention is used as a drive engine for a motor vehicle.

In a further preferred embodiment, the first and/or second fork sections extend approximately 90° with respect to the axis of rotation and with respect to the pivot axis and are constructed in the form of a spherical surface on the outside.

In a further preferred embodiment, one side of the first and/or second fork section which faces the piston rear side faces of the pistons is constructed so as to curve in a fashion which is essentially complementary to the piston rear side faces.

It is advantageous here that chambers which have a variable volume during the oscillating pivoting movement of the individual pistons and whose minimum volume can be virtually zero are formed between the piston rear side faces, ie. the sides of the pistons which face away from the piston working faces, and the respective side of the fork sections which faces these piston rear side faces.

This is particularly preferred if in each case admission pressure chambers which can be used to precompress combustion air, as is already provided in the known oscillating piston machine, are constructed between the piston rear side faces and the corresponding facing side of the fork section or fork sections. However, the abovementioned chambers can also be used in a simple manner as cooling chambers for cooling the pistons.

As in the known oscillating piston machine, in the oscillating piston machine according to the invention each piston has a running roller, the roller axis preferably being inclined at an angle of approximately 30° to 50°, preferably approximately 35°, with respect to the piston working face.

The running rollers are of preferably conical construction here, an imaginary prolongation of each cone resulting in a cone tip which is at the center point of the housing, the control mechanism being adapted in an optimum fashion to the spherical symmetry of the oscillating piston machine for the pivoting movement of the pistons.

Further advantages and features emerge from the following description and the appended drawing.

Of course, the features mentioned above and the features which are to be explained below can be applied not only in the respectively specified combination but also in other combinations or in isolation without departing from the scope of the present invention.

An exemplary embodiment of the invention is illustrated in the drawing and will be described in more detail with reference to said drawing, in which:

DETAILED DESCRIPTION OF THE DRAWINGS

Figure 1:
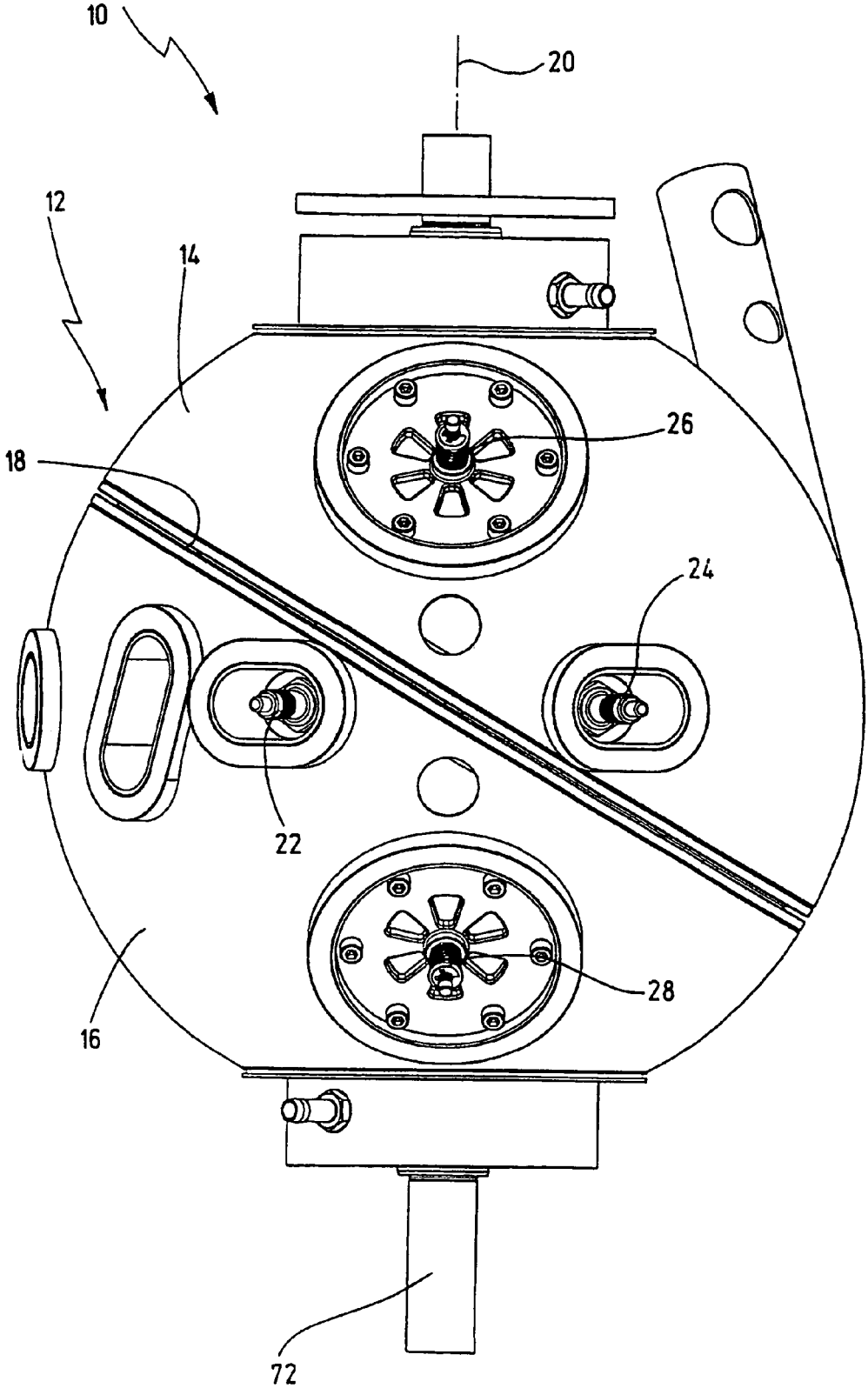
FIG. 1 is an overall view of an oscillating piston machine according to the invention with a closed housing.

The embodiment of an oscillating piston machine which is provided with the general reference number 10 is described in more detail below with reference to FIGS. 1 to 9. The oscillating piston machine 10 is used, for example and preferably, as an internal combustion engine.

The oscillating piston machine 10 has a housing 12 which is composed of a first housing half 14 and a second housing half 16.

The housing halves 14 and 16 are joined along a dividing line 18 which is not arranged so as to run perpendicularly but rather obliquely with respect to an axis 20 of symmetry of the oscillating piston machine 10 which at the same time also constitutes the axis of rotation of the pistons, as will be described later below. This oblique profile of the dividing line 18 for taking apart the housing halves 14 and 16 has the advantage that technical elements, such as spark plugs and nozzles 22, 24 and valves 26, 28, which are provided in the housing can be arranged suitably without these elements being adversely affected by the dividing line of the housing.

Figure 2:
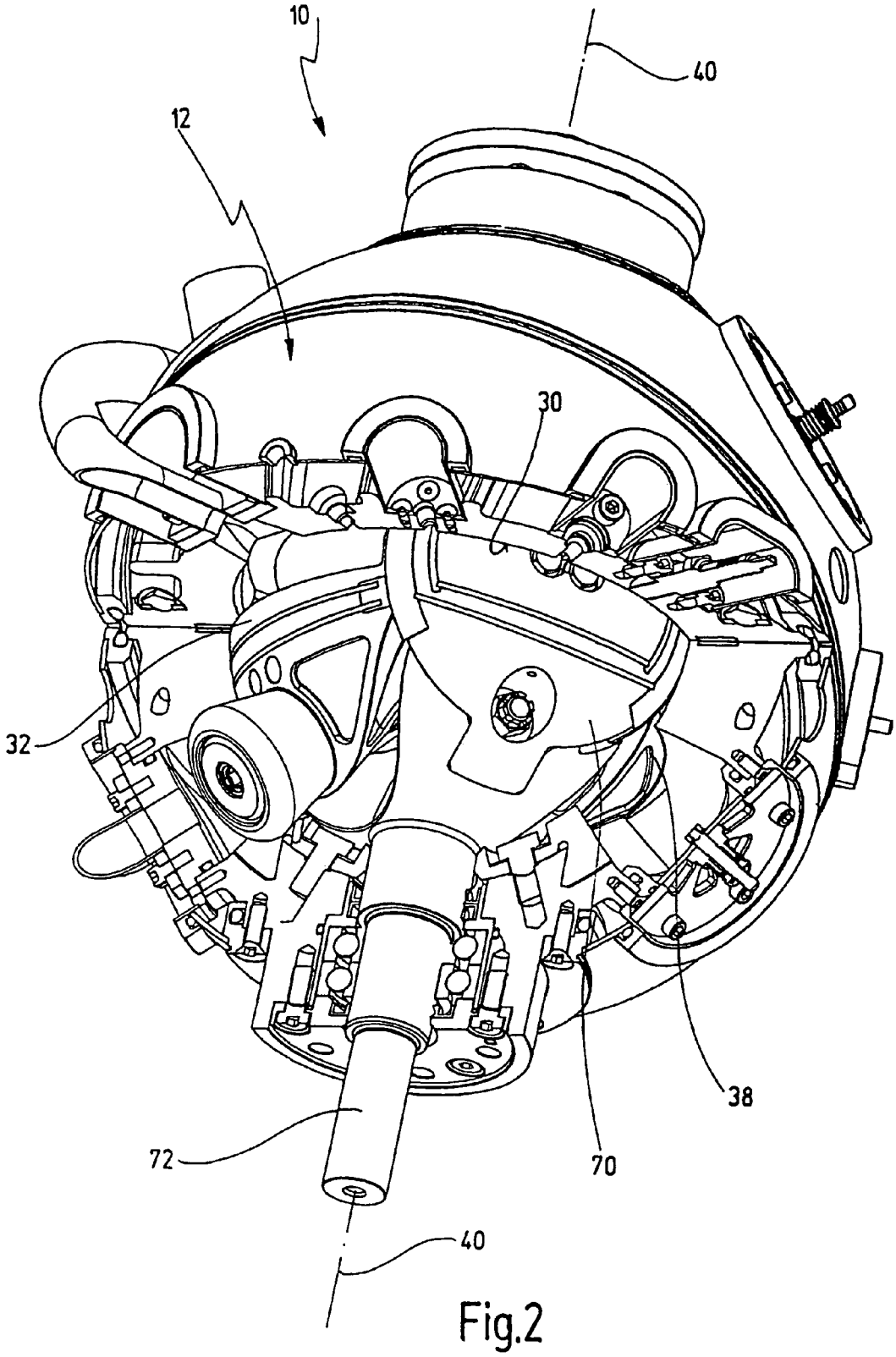
FIG. 2 shows the oscillating piston machine in FIG. 1, the housing being partially broken away, the oscillating piston machine being illustrated in a first operating position.
Figure 3:
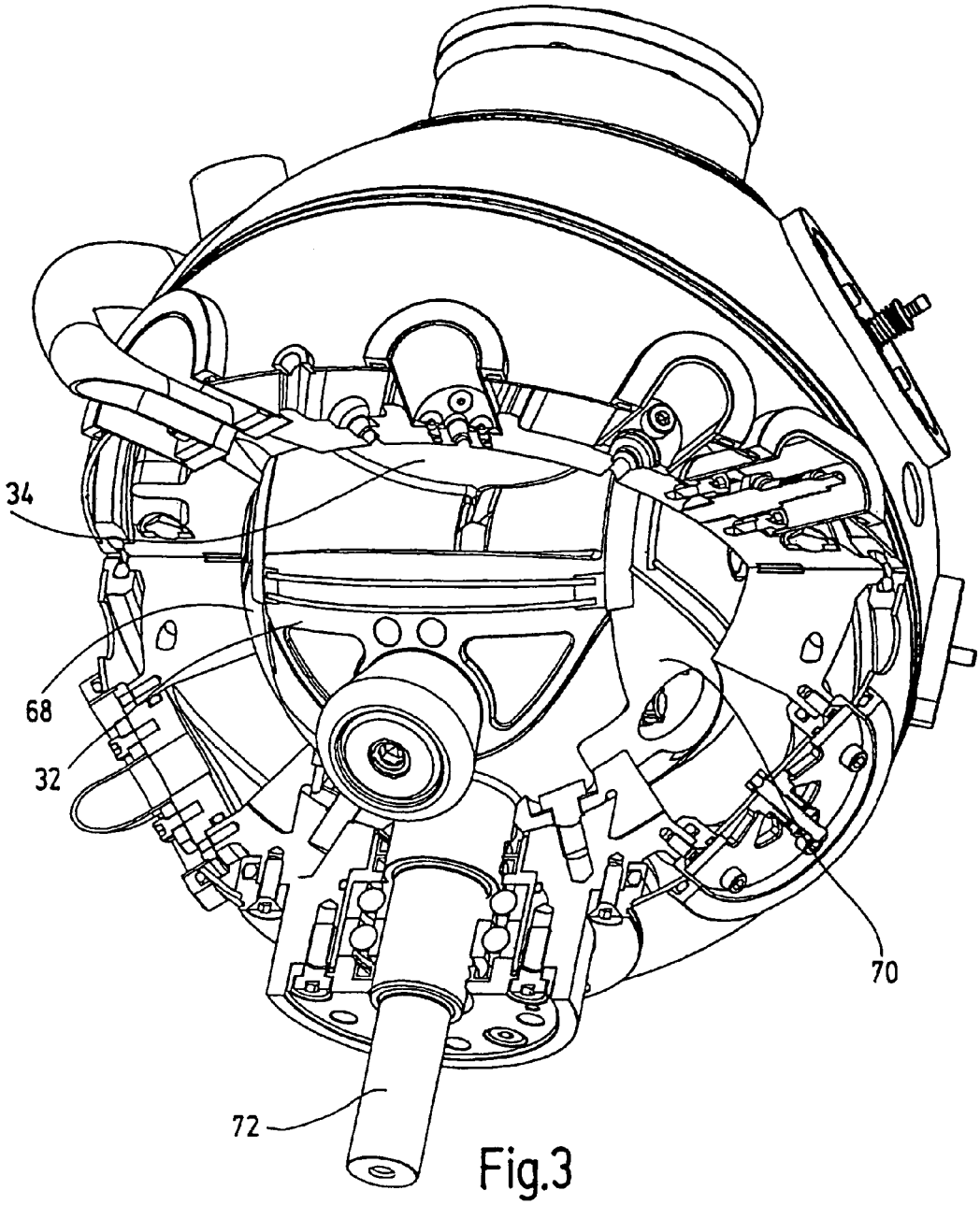
FIG. 3 shows the oscillating piston machine in FIGS. 1 and 2 in a different exemplary operating position.

In FIGS. 2 and 3, the housing 12 has been partially cut open in two sectional planes which are perpendicular with respect to one another, as a result of which further details of the oscillating piston machine 10 within the housing 12 can be seen. The illustrations in FIGS. 2 and 3 are not identical to FIG. 1 in terms of the previously described elements 22-28, which is however insignificant for the explanation of the present invention.

An inner wall 30 of the housing 12 is of essentially spherical construction.

Four pistons (cf. FIG. 9) 32, 34, 36, 38, which are partially concealed in FIGS. 2 to 8, are arranged in the housing 12. These pistons 32-38 rotate together about an axis 40 of rotation in the housing 12.

Figure 9:
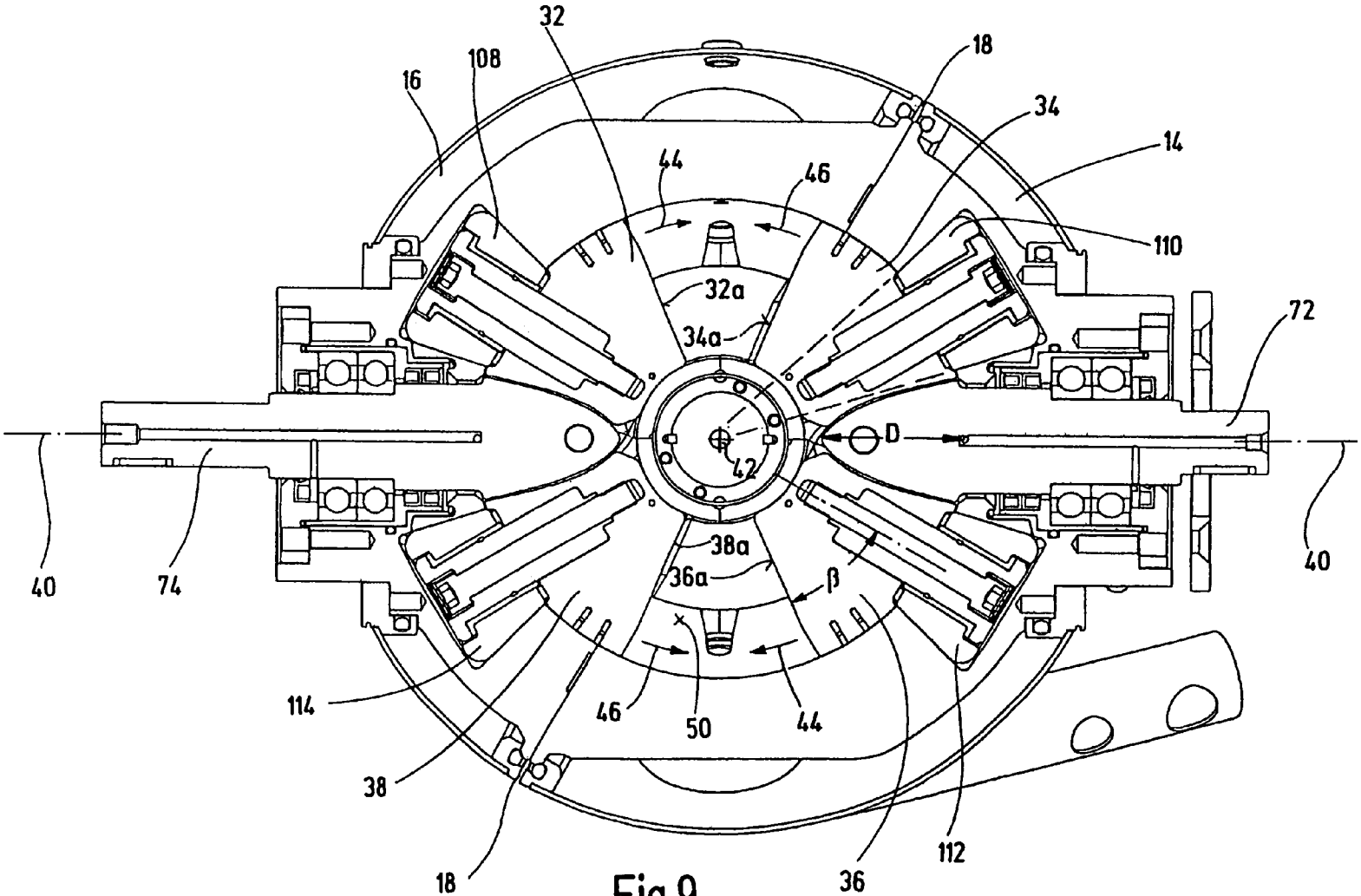
FIG. 9 shows a cross-sectional view of the oscillating piston machine in FIGS. 1 to 3, for the purpose of explaining further details thereof.

Furthermore, while the oscillating piston machine 10 is operating the pistons 32-38 carry out oscillating pivoting movements about a pivot axis 42 which is approximately perpendicular with respect to the axis 40 of rotation, as is indicated by arrows 44 and 46 in FIG. 9.

In each case two pistons which are diametrically opposite one another with respect to the center of the housing or the pivot axis 42 form here a rigid piston pair, specifically the pistons 32 and 36 form the piston pair 32/36, and the pistons 34 and 38 form the piston pair 34/38. As the pistons 32-38 rotate about the axis 40 of rotation, the piston pair 32/36 correspondingly carries out a pivoting movement about the pivot axis 42 in the direction of the arrows 44 (clockwise direction) if the piston pair 34/38 carries out a pivoting movement in the direction of the arrows 46 (counterclockwise direction), and vice versa.

In addition, details of the pistons 32-38 will be described in more detail with reference to FIGS. 4 to 6.

Each piston has a piston working face, ie. the piston 32 has a piston working face 32*a*, the piston 34 has a piston working face 34*a*, the piston 36 has a piston working face 36*a* and the piston 38 has a piston working face 38*a*. In FIG. 5, for example, only the piston working faces 32*a* and 34*a* of the pistons 32 and 34 are illustrated. The piston working faces 32*a* and 34*a* form a first working chamber or combustion recess 48, and the piston working faces 36*a* and 38*a* of the pistons 36 and 38 form a second working chamber or combustion recess 50 (cf. FIG. 9).

Figure 6:
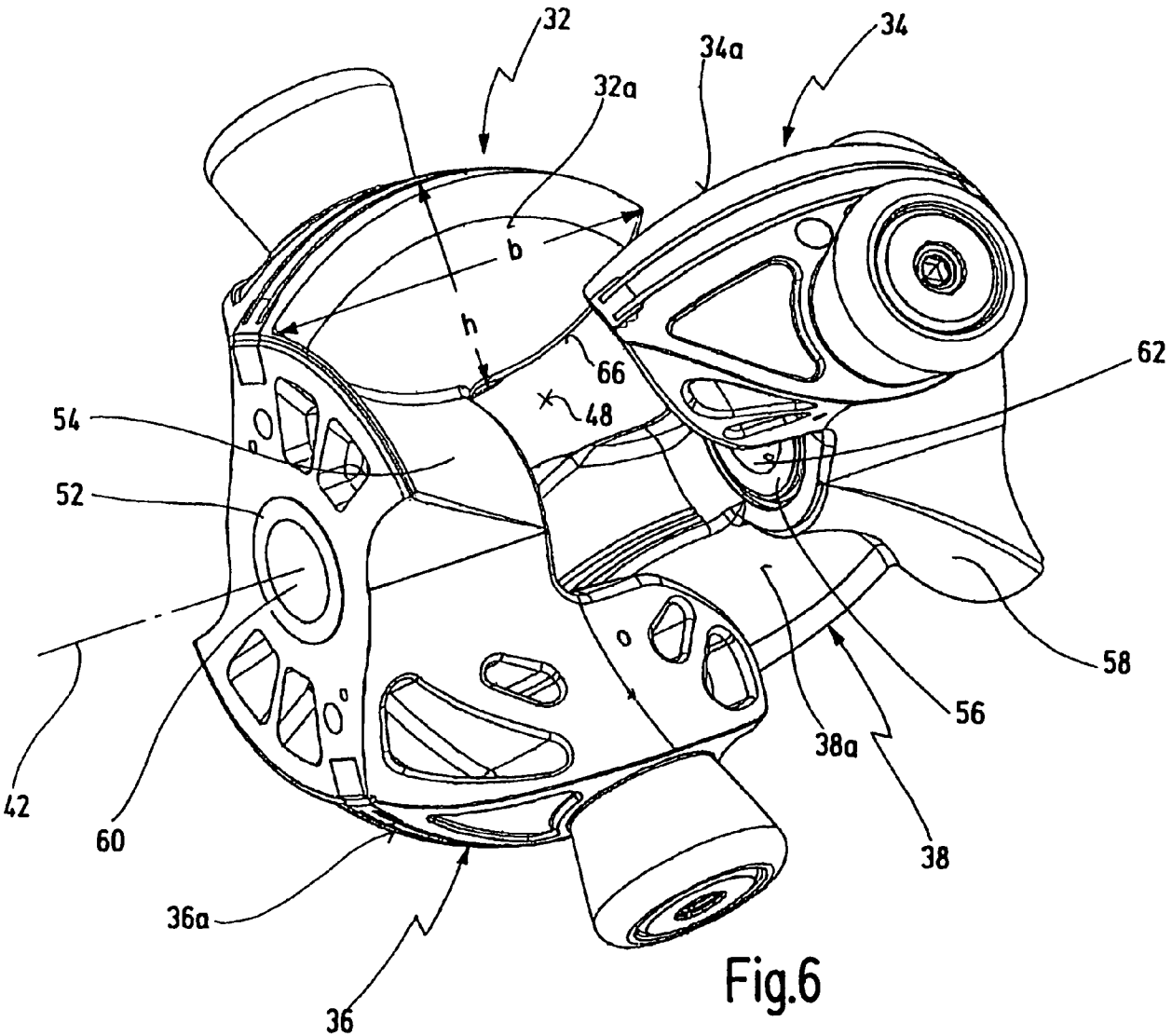
FIG. 6 shows the piston arrangement in FIG. 5 in an exploded view of the two piston pairs.

Each piston pair has one bearing section 52 for mounting the piston pair 32/36 on the pivot axis 42, and this is most clearly shown in the case of the piston pair 32/36 in FIG. 6. Furthermore, each piston pair has, as is also shown best for the piston pair 32/36 in FIG. 6, two side wall sections which delimit the working chambers 48 and 50 laterally. For the piston 32, the side wall section 54 which laterally delimits the working chamber 48 can be seen in FIG. 6. The bearing section 52 and the side wall section 54 (or the side wall section of the piston 36 which is diametrically opposite the side wall section 54, and is not shown in FIG. 6) are constructed integrally with one another and are arranged on the same side of the respective piston pair 32/36, and 34/38, as can be seen best for the piston pair 32/36 in FIG. 6. A bearing section 56 and a side wall section 58 of the piston pair 34/38 can be seen partially in FIG. 6.

The bearing sections 52 and 56 of the piston pairs 32/36 and 34/38 are of symmetrical construction with respect to the pivot axis 42, a further side wall section—concealed in the figures—being approximately diametrically opposite the side wall section 54 with respect to the pivot axis 42, and likewise a further side wall section—which is not shown in FIG. 6—is diametrically opposite the side wall section 58 of the piston pair 34/38 with respect to the pivot axis 42.

Figure 7:
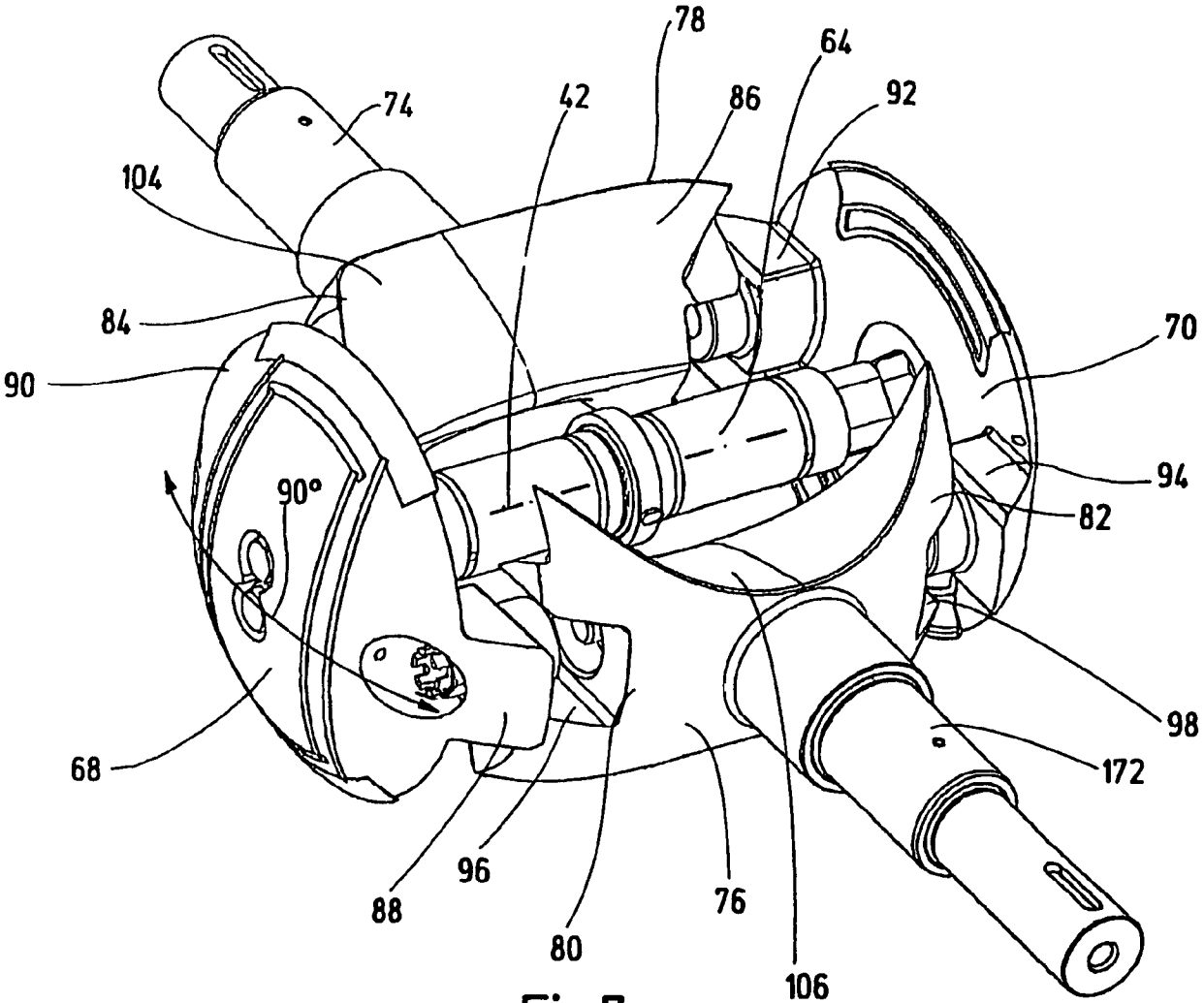
FIG. 7 shows an exploded view of the arrangement composed of the journal, the end elements and the two output shafts with fork sections of the oscillating piston machine in FIGS. 1 to 3 in isolation.

The bearing section 52 and the bearing section 56 each have a drilled hole 60 or 62 with which the piston pairs 32/36 and 34/38 are pivotably mounted on a fixed journal 64 (cf. FIG. 7).

The bearing sections 52 and 56 extend in the direction of the pivot axis 42 over approximately half the width of the respective piston pair 32/36 and 34/38 respectively, with respect to the direction of the pivot axis 42. If the two piston pairs 32/36 and 34/38 are then arranged—as illustrated in FIG. 5—in a criss-cross fashion with respect to the pivot axis 42, the piston pairs 32/36 and 34/38 are mounted in their entirety over the entire length of the journal 64 and are thus particularly stable about the pivot axis 42.

Figure 5:
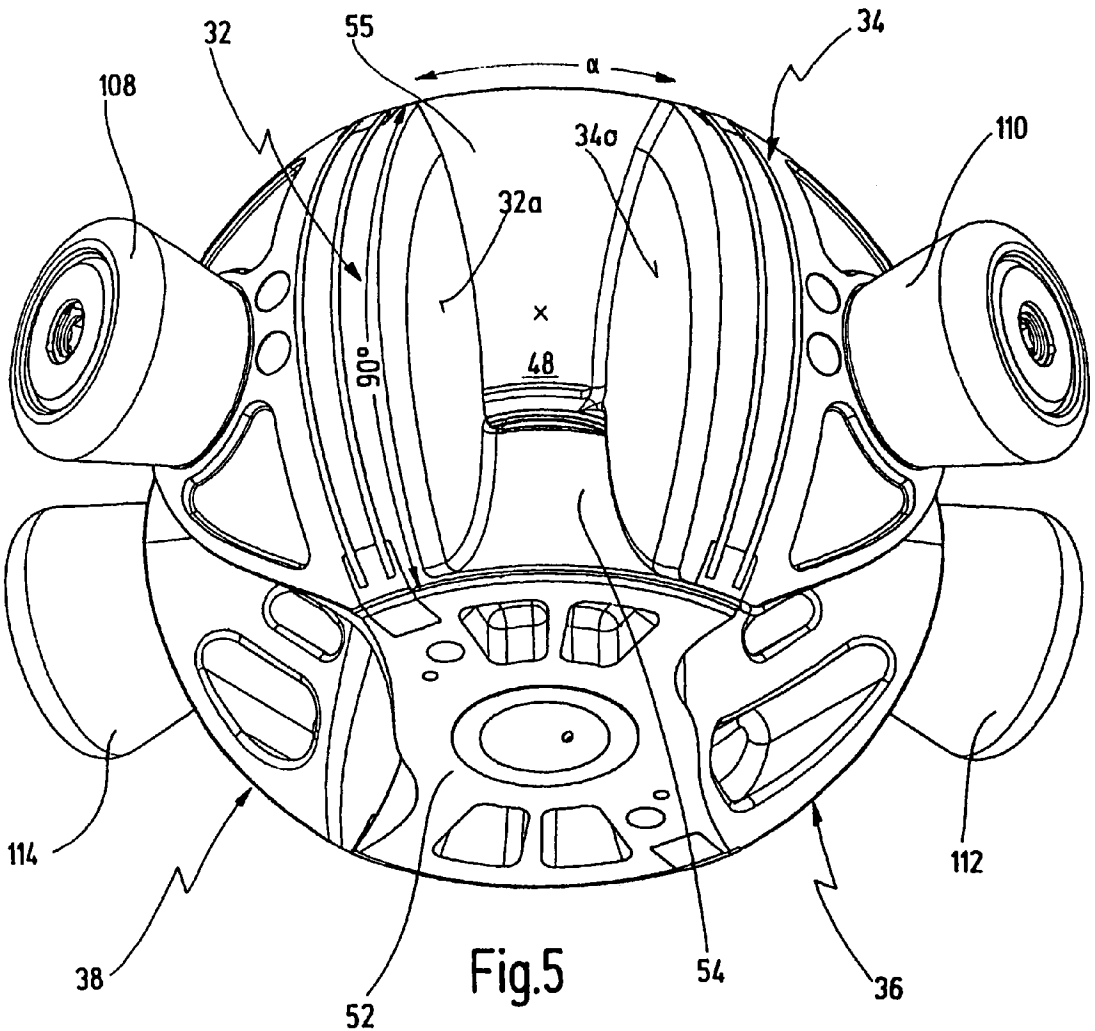
FIG. 5 shows the arrangement composed exclusively of the pistons in a view which is enlarged in comparison with FIG. 4.

FIG. 5 shows the side wall section 55 of the piston 34 which delimits the working chamber 48 laterally, together with the side wall section 54 of the piston 32.

The respective side wall section 54, 55 (FIG. 5) extends on the associated bearing section 52 and 56 so as to curve concavely from the outside to the inside and from top to bottom, as is clearest from the representations in FIGS. 5 and 6. Here, the respective side wall section 54, 55 and the further side wall sections which are not shown in FIG. 5 extend in the direction of the pivot axis 42, over the entire length of the bearing section 52 or 56, in the direction of the pivot axis 42.

As a result of the integration of the side wall sections 54, 55 (and the remaining side wall section 58 which is not shown in FIGS. 5 and 6) into the bearing sections 52 and 56, the bearing sections 52 and 56 are constructed in a very solid and stable fashion, in particular at the outer ends of the journal 64.

As a result of the curvature of the side wall sections 54 and 58 and of the corresponding associated side wall sections (not shown in the figures), curved working chambers and combustion recesses 48 and 50 are produced, and only the piston working faces 32*a* to 38*a* are embodied in a planar fashion, as a result of which the pressure which is formed after the ignition during the expansion of the fuel/air mixture acts almost exclusively on the working piston faces 32*a* to 38*a*, as is desired for a high degree of efficiency.

Each piston 32-38 has, at its end opposite the side wall section, a side face whose shape is matched to the side wall section of that piston together with which this piston forms the respective working chamber.

FIG. 6 illustrates this for the piston 32 whose end opposite the side wall section 54 has a side face 66 whose shape is matched to the side wall section of the piston 34, the pistons 32 and 34 forming the working chamber 48. The side wall section of the piston 34 which is not shown in FIG. 6 has, with the exception of mirror reversal, the same shape as the side wall section 54 of the piston 32. The same applies correspondingly to the other pistons 36, 38.

Each piston 32-38 extends approximately 90° about the axis 40 of rotation, as is shown for piston 32 in FIG. 5.

Furthermore, a ratio between a dimension b of each piston 32-38 in the direction of the pivot axis 42 and a dimension h of each piston 32-38 transversely with respect to the pivot axis 42, that is to say a ratio composed of the width and height of each piston working face 32*a* to 38*a*, is in the range from approximately 1.5:1 to 2.5:1, and in the present case this ratio is 2.2:1.

Furthermore, a maximum angle $\alpha$ of aperture of the working chambers 48 and 50 about the pivot axis 42 is in the range from approximately 40° to approximately 60°, as is illustrated for the working chamber 48 in FIG. 5. The maximum angle of aperture is approximately 0° here.

As already mentioned, the two piston pairs 32/36 and 34/38 with the bearing sections 52 and 56 are seated on the journal 64 (FIG. 7). An end element 68 or 70 which is in the form of a spherical cap and which, as illustrated in FIG. 4, holds the piston pairs 32/36 and 34/38 against one another in the direction of the pivot axis 42 is arranged at the ends of the journal 64. Only the two end elements 68, 70 together with the journal 64 and without the pistons are illustrated in FIG. 7. The end elements 68 and 70 are permanently bolted to the journal 64 during mounting. The journal 64 serves as a bearing for the piston pairs 32/36 and 34/38 for the oscillating pivoting movement of the pistons 32/38.

The end elements 68 and 70 extend approximately 90° about the axis 40 of rotation (cf. FIG. 8), and also about an axis perpendicularly with respect to the pivot axis 42 and to the axis (40) of rotation (cf. FIG. 7).

The oscillating piston machine 10 also has two output shafts 72 and 74 (cf. in particular FIGS. 4 and 7) to which the pistons 32-38 are connected fixed in terms of rotation. In order to connect the output shafts 72 and 74 in a rotatable fashion, each of the two has, at one end, a fork section 76 (output shaft 72) or 78 (output shaft 74). The output shafts 72 and 74 are connected fixed in terms of rotation to their respective fork section 76 and 78.

The fork sections 76 and 78 end outside the pivot axis 42, as is applied in particular for FIG. 7, ie. the output shafts 72 and 74 do not extend to the center of the housing but rather end outside the center of the housing.

The fork sections 76 and 78 each have end sections 80, 82 and 84, 86, which are arranged between the end elements 68 and 70 which are in the form of spherical caps, and are connected directly to them in a releasable fashion, a screwed connection being used here for the releasable connection, as is illustrated in FIG. 7.

However, the connection is made not only by means of screws but also the end sections 80, 82 and 84, 86 are connected to the end elements 68 and 70 in a positively locking fashion, for which purpose the end elements 68 have lateral projections, specifically projections 88, 90 (end element 68) and 92, 94 (end element 70) which engage in corresponding grooves 96, 98 (here shown only for the fork section 76).

Figure 8:
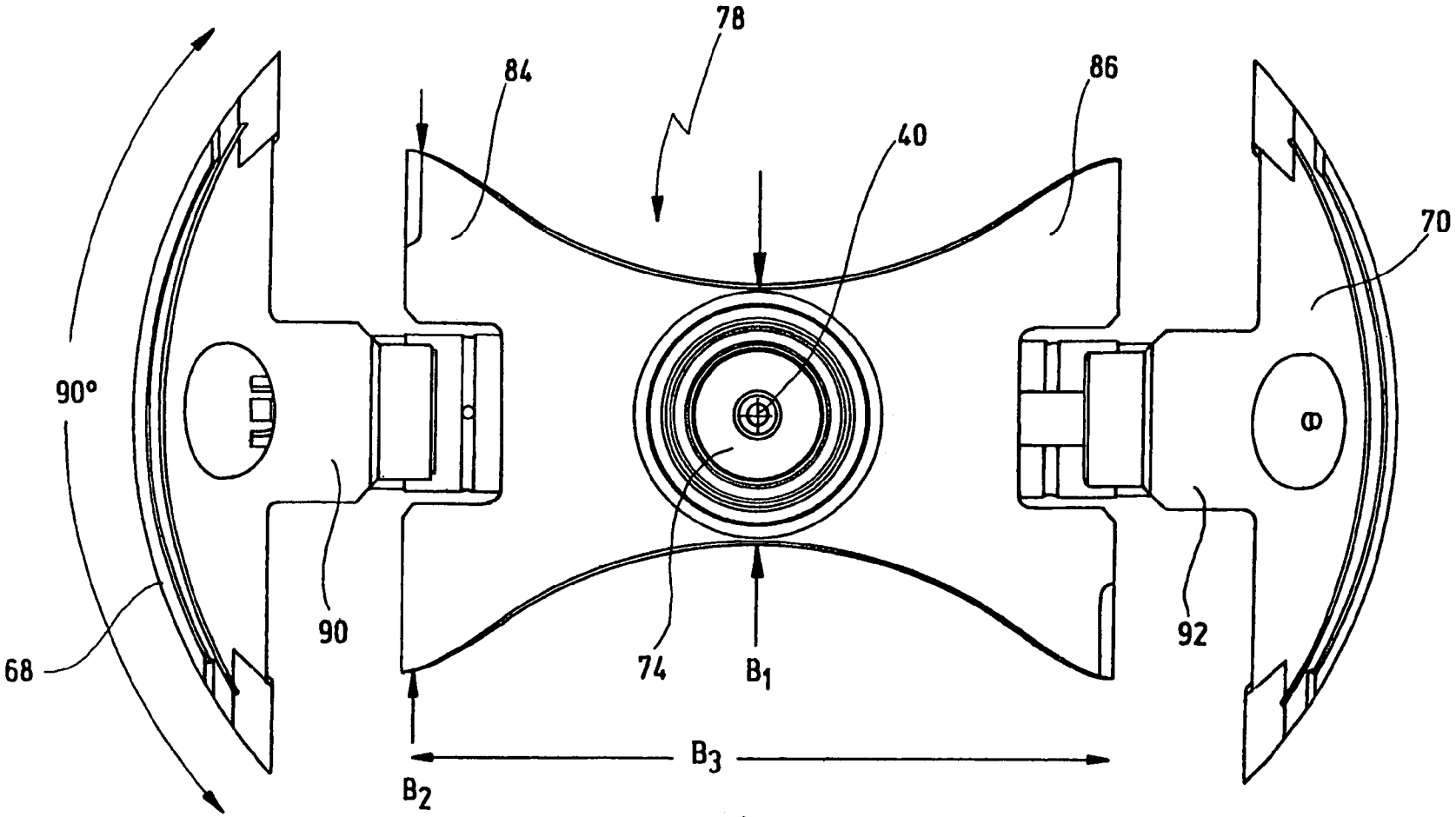
FIG. 8 shows a view along the output shaft in the direction of the arrangement composed of the two end elements and a fork section.

As is apparent in particular from FIG. 8, the end sections 80, 82 and 84, 86 of the fork sections 76, 78 widen starting from the respective output shaft 72 and 74, to their outer end.

Here, a ratio between a dimension $B_1$ of the fork section 76 or 78 in its center in the direction perpendicularly to the pivot axis 42 with respect to the corresponding dimension $B_2$ of the fork section 76 or 78 at its ends is in the range from approximately 1:1.5 to 1:2.5, in the present case approximately 1:2.

Furthermore, a ratio between the dimension $B_2$ of the fork sections 76 and 78 with respect to the dimension $B_3$ of the fork section 76 or 78 in the direction of the pivot axis 42 is in the range from approximately 1:2 to 1:4, in the present case approximately 1:1.375.

A thickness D of the fork sections 76 and 78 in the region of the respective drive shafts 72 and 74, ie. in the center of the respective fork section 76 or 78, has a ratio with respect to the dimension $B_3$ in the range from approximately 1:2 to 1:4, in the present case approximately 1:2.75.

The extent of the fork sections 76 and 78 with respect to the dimension $B_3$ is, expressed as an angle about an axis which is both perpendicular with respect to the axis 40 of rotation and to the pivot axis 42, approximately 90°, so that the two fork sections 76 and 78 form, together with the end elements 68 and 70, a solid angle of 360°, that is to say a sphere, about this axis, for which purpose the outer sides of the fork sections 76 and 78 are correspondingly constructed in the shape of a spherical surface.

The ratio between the dimension $B_1$ and the dimension $B_3$ is in the range from approximately 1:2 to approximately 1:4, here approximately 1:2.75.

Correspondingly, the ratio between the diameter of the output shafts 72 and 74 at their end which is connected directly to the fork sections 76 and 78 and which is only slightly smaller than the dimension $B_1$ is approximately in the same, previously mentioned ratio.

Figure 4:
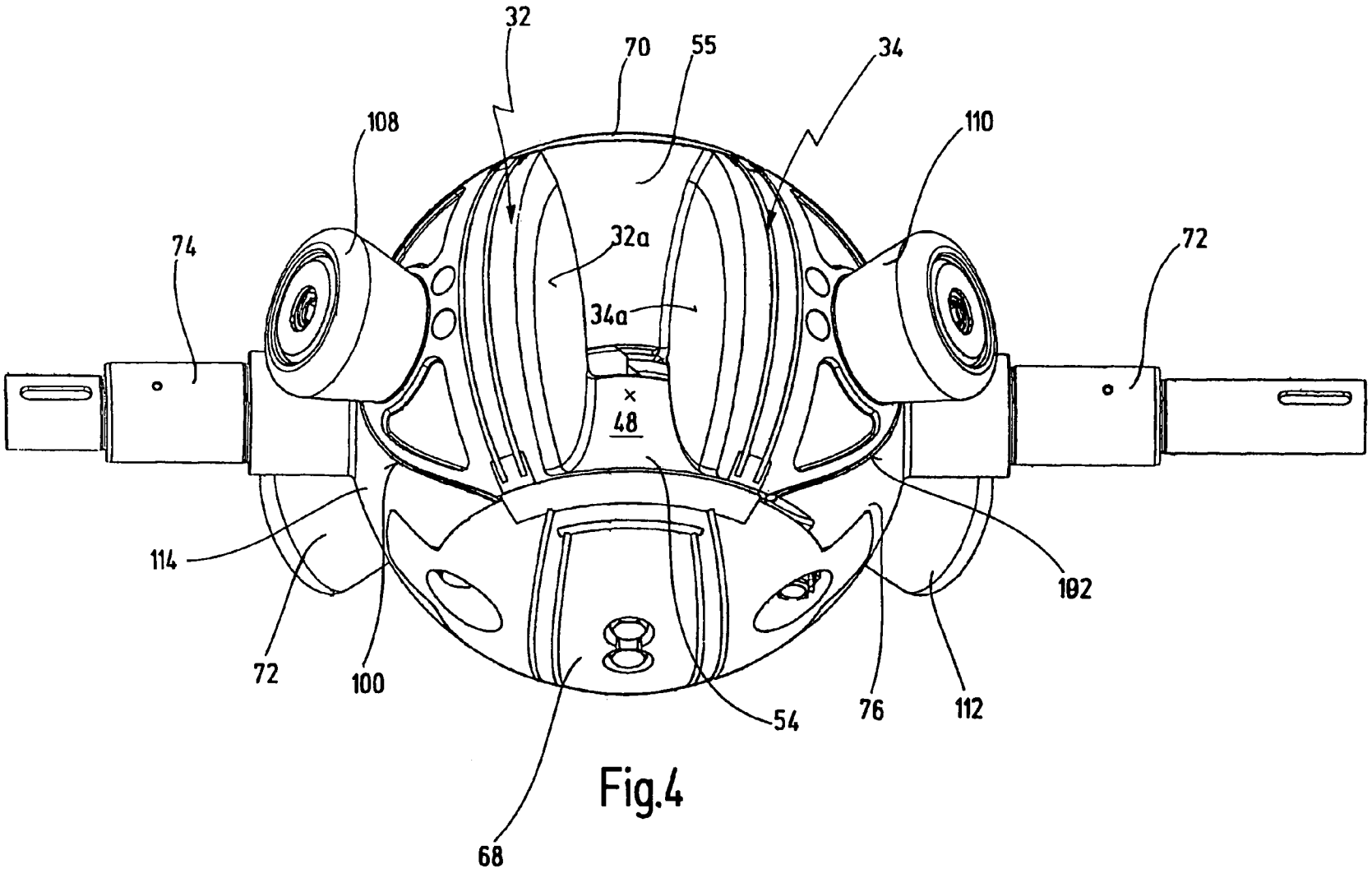
FIG. 4 shows a perspective view of an overall arrangement composed of piston, end elements and drive shafts with fork sections of the oscillating piston machine in FIGS. 1 to 3.

As is apparent most clearly from FIG. 4, each piston 32-38 has a piston rear side face, as illustrated in FIG. 4 with the reference 100 for the piston 32 and 102 for the piston 34, which are of curved construction, one side 104 or 106 (cf. FIG. 7) which faces these piston rear side faces 100 and 102 being constructed so as to curve in a fashion which is complementary to these piston rear side faces 100 and 102.

Between the piston rear side faces 100 and 102 (the same applies to the other pistons 36 and 38) and the corresponding facing side 104 and 106 (and correspondingly the two further sides of the fork sections 76 and 78), two chambers are therefore formed which become smaller and larger in inverse proportion to the working chambers 48 and 50 and can be used as admission pressure chambers and/or cooling chambers.

With respect to the use as admission pressure chambers and the method in which the admission pressure chambers communicate with the working chambers, reference is made in particular to the document WO 03/067033 A1 whose content is herewith expressly incorporated into the present application.

Finally, as is apparent most clearly from FIG.5, each piston has a running roller 108 (piston 32), 110 (piston 34), 112 (piston 36) and 114 (piston 38). The running rollers 108-114 are part of a control mechanism for deriving the oscillating pivoting movement of the individual pistons 32-38 from their rotating movement about the axis 40 of rotation.

As is illustrated in FIG. 9 for the running roller 112 of the piston 36, the roller axis of each roller 108-114 is inclined at an angle β of approximately 30° to 50°, approximately 35° in the present case, with respect to the corresponding piston working face 32*a*-38*a*.

As is apparent from FIGS. 4, 5 and 9, the running rollers 108-114 are of conical construction, an imaginary prolongation of each cone resulting in a cone tip which is in the center point of the housing 12, as is indicated in FIG. 9 for the running roller 110 of the piston 34.

In FIG. 4, the completely premountable arrangement composed of the pistons 32-38, the end elements 68 and 70 and the output shafts 72 and 74 with the respective fork sections 76 and 78 is illustrated. Correspondingly, the running rollers 108-114 are also already mounted on the pistons 32-38. The entire arrangement which is illustrated in FIG. 4 and, with the exception of the working chambers 48 and 50, is in the shape of an enclosed solid sphere, then needs to be enclosed essentially only by the housing halves 14 and 16 in order to form the oscillating piston machine 10.

In FIG. 2, the oscillating piston machine 10 with the pistons 32-38, of which however not all are visible, is illustrated in a first operating position, while the pistons 32-38 in the illustration according to FIG. 3 have moved on slightly about the axis 40 of rotation in comparison with FIG. 2, and in doing so have at the same time executed a corresponding pivoting travel about the pivot axis 42.

With respect to the method of functioning and the method of operation of the oscillating piston machine 10 reference is also made here to the document WO 03/067033 A1 whose content is incorporated in this respect into the present disclosure.

What is claimed is:

1. An oscillating piston machine, comprising a housing which has an essentially spherical housing inner wall, four pistons which rotate together about an axis of rotation which is approximately in the center of the housing being arranged in the housing, in which case, of the four pistons, in each case two pistons which are approximately diametrically opposite one another with respect to the center of the housing form a rigid piston pair, the two piston pairs being capable of pivoting to and fro in opposite directions about a common pivot axis which runs approximately perpendicularly with respect to the axis of rotation, the two piston pairs being arranged in criss-cross fashion with respect to the pivot axis in such a way that in each case two pistons of the two piston pairs have their piston working faces opposite one another in order to form a working chamber between them, each piston pair having a bearing section for mounting the piston pair on the pivot axis, and in each case a side wall section for each piston of the piston pair, for laterally delimiting one of the working chambers in each case, characterized in that the bearing section and the side wall section, for each piston pair, are fixed relative to one another and are arranged on the same side of the respective piston pair.

2. The oscillating piston machine of claim 1, characterized in that the bearing section extends in the direction of the pivot axis, over approximately half the width of the piston pair in the direction of the pivot axis.

3. The oscillating piston machine claim 1, characterized in that each piston has, at its end opposite the side wall section, a side face whose shape is matched to the side wall section of that piston together with which this piston forms the respective working chamber.

4. The oscillating piston machine claim 1, characterized in that each individual piston extends approximately 90° about the axis of rotation.

5. The oscillating piston machine claim 1, characterized in that a ratio between a dimension (b) of each piston in the direction of the pivot axis and a dimension (h) of each piston transversely with respect to the pivot axis is in the range from approximately 1.5:1 to 2.5:1, preferably 2.2:1.

6. The oscillating piston machine claim 1, characterized in that a maximum angle (α) of aperture of the working chambers about the pivot axis is in the range from approximately 40° to approximately 60°.

7. The oscillating piston machine claim 1, characterized in that the two piston pairs are seated with their bearing sections on a journal which forms the pivot axis, and wherein in each case an end element which is in the form of a spherical cap and which holds the piston pairs against one another in the direction of the pivot axis is arranged at the ends of the journal.

8. The oscillating piston machine of claim 7, characterized in that the end element which is in the form of a spherical cap extends approximately 90°about the axis of rotation.

9. The oscillating piston machine of claim 7, characterized in that the end element which is in the form of a spherical cap extends approximately 90°about an axis which is perpendicular with respect to the axis of rotation and to the pivot axis.

10. The oscillating piston machine claim 7, characterized in that the pistons are connected to at least one output shaft which can rotate about the axis of rotation and which ends at the piston end in a first fork section outside the pivot axis, which section is arranged with its two end sections between the end elements and is directly connected to them in a releasable fashion.

11. The oscillating piston machine of claim 10, characterized in that the end sections of the first fork section have a positively locking connection to the end elements.

12. The oscillating piston machine of claim 10, characterized in that the end sections of the first fork section widen starting from the output shaft to their outer end.

13. The oscillating piston machine claim 10, characterized in that a ratio between the dimension (B1) of the fork section in the direction perpendicular to the pivot axis in its center with respect to the corresponding dimension (B2) of the fork section at its ends is in the range from approximately 1:1.5 to 1:2.5.

14. The oscillating piston machine of claim 13, characterized in that a ratio between the dimension (B1) of the fork section in the direction perpendicular to the pivot axis in its center with respect to the corresponding dimension (B2) of the fork section at its ends is approximately 1:2.

15. The oscillating piston machine claim 10, characterized in that a ratio between the dimension (B2) of the fork section in the direction perpendicular to the pivot axis at its ends with respect to the dimension (B3) of the fork section in the direction of the pivot axis is in the range from approximately 1:2 to approximately 1:4.

16. The oscillating piston machine of claim 15, characterized in that a ratio of the thickness (D) of the fork section in the region of the output shaft with respect to the dimension (B3) of the fork section in the direction of the pivot axis is approximately 1:2.75.

17. The oscillating piston machine of claim 10, characterized in that a ratio of the thickness (D) of the fork section in the region of the output shaft with respect to the dimension (B3) of the fork section in the direction of the pivot axis is in the range from approximately 1:2 to 1:4.

18. The oscillating piston machine of claim 17, characterized in that a ratio of the thickness (D) of the fork section in the region of the output shaft with respect to the dimension (B3) of the fork section in the direction of the pivot axis is approximately 1:2.75.

19. The oscillating piston machine of claim 10, characterized in that a second fork section which is essentially identical in shape and which is also connected to the end elements in a releasable fashion is arranged opposite the first fork section.

20. The oscillating piston machine of claim 10, characterized in that the second fork section has a further output shaft.

21. The oscillating piston machine of claim 10, characterized in that the first and/or second fork sections extend/extends approximately 90° about an axis which is perpendicular with respect to the axis of rotation and with respect to the pivot axis and are/is in the form of a spherical surface on the outside.

22. The oscillating piston machine claim 10, characterized in that one side of the first and/or second fork section which faces piston rear side faces of the pistons is constructed so as to curve in a fashion which is essentially complementary to the piston rear side faces.

23. The oscillating piston machine of claim 10, characterized in that admission pressure chambers and/or cooling chambers are constructed between the piston rear side faces and the corresponding facing side of the fork section or fork sections.

24. The oscillating piston machine of claim 1, characterized in that each piston has a running roller whose roller axis is inclined at an angle of approximately 30° to 50° with respect to the piston working face.

25. The oscillating piston machine of claim 24, characterized in that the running rollers are of conical construction, an imaginary prolongation of each cone resulting in a cone tip which is at the center point of the housing.

26. The oscillating piston machine of claim 24, characterized in that each piston has a running roller whose roller axis is inclined at an angle of approximately 35°, with respect to the piston working face.

27. An oscillating piston machine, comprising a housing which has an essentially spherical housing inner wall, four pistons which rotate together about an axis of rotation which is approximately in the center of the housing being arranged in the housing, in which case, of the four pistons, in each case two pistons which are approximately diametrically opposite one another with respect to the center of the housing form a rigid piston pair, the two piston pairs being capable of pivoting to and fro in opposite directions about a common pivot axis which runs approximately perpendicularly with respect to the axis of rotation, the two piston pairs being arranged in criss-cross fashion with respect to the pivot axis in such a way that in each case two pistons of the two piston pairs have their piston working faces opposite one another in order to form a working chamber between them, each piston pair having a bearing section for mounting the piston pair on the pivot axis, and in each case a side wall section for each piston of the piston pair, for laterally delimiting one of the working chambers in each case, characterized in that the bearing section and the side wall sections are constructed integrally with one another and are arranged on the same side of the respective piston pair; characterized in that the respective side wall section extends on the bearing section so as to curve concavely from the outside to the inside and from the top to the bottom.

28. The oscillating piston machine of claim 27, characterized in that the respective side wall section extends in the direction of the pivot axis over the entire length of the bearing section.

* * * * *